US005597974A

United States Patent [19]

Voreck, Jr. et al.

[11] Patent Number: 5,597,974

[45] Date of Patent: Jan. 28, 1997

[54] SHAPED CHARGE FOR A PERFORATING GUN HAVING A MAIN BODY OF EXPLOSIVE INCLUDING TATB AND A SENSITIVE PRIMER

[75] Inventors: Wallace E. Voreck, Jr., Sparta, N.J.; James E. Brooks, Manvel, Tex.; John R. Eberhardt; Hooshang A. Rezaie, both of Houston, Tex.

[73] Assignee: Schlumberger Technology Corporation, Houston, Tex.

[21] Appl. No.: 610,025

[22] Filed: Mar. 4, 1996

[51] Int. Cl.[6] ..... F42B 1/02

[52] U.S. Cl. ..... 102/307; 102/318; 102/275.5

[58] Field of Search ..... 102/306, 307, 102/318, 202.5, 275.4, 275.5

[56] References Cited

U.S. PATENT DOCUMENTS

| | | | |
|---|---|---|---|
| 3,985,595 | 10/1976 | Benziger | 149/19.3 |
| 4,032,377 | 6/1977 | Benziger | 149/105 |
| 4,091,729 | 5/1978 | Bell et al. | 102/38 |
| 4,168,191 | 9/1979 | Benziger | 149/19.91 |
| 4,300,962 | 11/1981 | Stinecipher | 149/92 |
| 4,481,371 | 11/1984 | Benziger | 149/92 X |
| 4,527,481 | 7/1985 | Evans et al. | 102/204 |
| 5,331,894 | 7/1994 | Wassell et al. | 102/275.12 |
| 5,386,780 | 2/1995 | Klein | 102/313 |
| 5,413,048 | 5/1995 | Werner et al. | 102/307 |
| 5,505,134 | 4/1996 | Brooks et al. | 102/203.7 |

OTHER PUBLICATIONS

Temperature–Dependent Shock Initiation of TATB–Based High Explosives by J. C. Dallman and J. Wackerie, Los Alamos National Laboratory, Los Alamos, New Mexico 97544 (Dallman, #110) p. 9.

Description of TATB pp. T–34 to T–55.

*Primary Examiner*—Peter A. Nelson

*Attorney, Agent, or Firm*—John H. Bouchard; John J. Ryberg

[57] ABSTRACT

A shaped charge includes a main body of explosive and a primer adapted to detonate said main body of explosive. In accordance with the present invention, the main body of explosive now includes an explosive composition known as sym-triaminotrinitrobenzene (TATB) and, since TATB is not sensitive enough to be a primer, the primer must consist of an explosive composition which is more sensitive than TATB. It has been discovered that, when the main body of explosive in a shaped charge is modified to include the explosive composition known as TATB and when the primer includes an explosive other than TATB, such as HNS or NONA or PYX or HMX, or a mixture of HNS or NONA or DODECA or PYX or HMX and TATB and when the shaped charge is detonated, the detonated charge will produce a jet that is longer in length than the jet associated with prior art shaped charges which did not have a main body of explosive that included TATB. As a result, when the longer jet is produced from the shaped charge of the present invention, that has been modified to include a main body of explosive comprising TATB and a primer which is more sensitive than said TATB, the longer jet will produce a longer perforation in a formation penetrated by a wellbore and, as a result, an increased quantity of wellbore fluid will be produced from the perforated formation. A detonating cord could also include the TATB explosive.

23 Claims, 1 Drawing Sheet

SHAPED CHARGE FOR A PERFORATING GUN HAVING A MAIN BODY OF EXPLOSIVE INCLUDING TATB AND A SENSITIVE PRIMER

BACKGROUND OF THE INVENTION

The subject matter of the present invention relates to a shaped charge for use in a perforating gun, the shaped charge including a main body of explosive which further includes sym-triaminotrinitrobenzene (TATB) and a primer, more sensitive than TATB, adapted to initiate the detonation of the main body of explosive. The subject matter also relates to other downhole explosive devices, such as casing and tubing cutters, boosters, detonating cord and detonators.

Shaped charges include a main body of explosive, known as a secondary explosive, which detonates when a primary explosive pellet detonates in response to a detonation wave propagating in a detonating cord. When the main body of explosive detonates, a jet is formed which propagates outwardly from the shaped charge. Shaped charges have been used in perforating guns, and perforating guns are used to perforate a formation penetrated by a wellbore. When the jet is formed from the shaped charge in the perforating gun, the jet perforates the formation and, in response, a wellbore fluid is produced from the perforated formation. The length of the jet produced from the shaped charge will determine the length of the perforation in the formation and potentially the amount of wellbore fluid produced form the perforated formation. However, the length of the jet propagating from the shaped charge in the perforating gun is determined, among other parameters, by the type of explosive which is used to constitute the main body of explosive in the shaped charge. For high temperatures, above HMX temperature limits, an explosive known as I-INS has been used as the main body of explosive in the shaped charges in the perforating gun. In addition, shaped charges which utilize HNS as the main body of explosive have performed satisfactorily in the past. However, development efforts continue to focus on better apparatus, compositions, and methods to produce a longer jet propagating from the shaped charge. If a longer jet is produced from a detonated shaped charge, the longer jet would produce a longer perforation in the formation, and a longer perforation in the formation penetrated by the wellbore could potentially increase the production of wellbore fluid from the perforated formation. Therefore, a primary object of this invention relates to providing an improved explosive composition adapted for use in a shaped charge for producing a longer jet from the shaped charge when the charge is detonated. Since the shaped charge is adapted for use in a perforating gun for perforating a formation penetrated by a wellbore, when the perforating gun is detonated, the longer jet will produce a longer perforation in the formation, and the longer perforation will cause increased quantities of wellbore fluid to be produced from the perforated formation.

SUMMARY OF TIE INVENTION

Accordingly, it is a primary object of the present invention to provide an improved explosive composition adapted for use in a shaped charge, the improved explosive composition in the shaped charge including a primer and a main body of explosive, the main body of explosive, when detonated by the primer, causing a longer jet to be produced from the shaped charge and the longer jet further producing a longer perforation in a formation penetrated by a wellbore.

It is a further object of the present invention to provide a shaped charge adapted for use, for example, in a perforating gun, the shaped charge including a main body of explosive that further includes an explosive composition known as sym-triaminotrinitrobenzene (hereinafter called "TATB"), and a primer adapted for initiating a detonation of the TATB explosive disposed in the main body of explosive, the primer including a further explosive composition which is more sensitive than TATB alone.

In accordance with these and other objects of the present invention, a shaped charge includes a main body of explosive and a primer which is adapted for initiating detonation of the main body of explosive, a jet being produced from the shaped charge when the main body of explosive is detonated. In accordance with the present invention, the main body of explosive in the shaped charge now includes an explosive composition known as symtriaminotrinitrobenzene (TATB). However, in addition, since TATB cannot, by itself be detonated by a detonation wave propagating in a detonating cord, in order to detonate the TATB in the main body of explosive, the primer must include an explosive composition other than pure TATB, such as HNS, NONA, DODECA, PYX, HMX or some primer mixture of either HNS, NONA, DODECA, PYX, HMX, with the TATB. As a result, when the main body of explosive in a shaped charge is modified to include an explosive composition known as TATB and when the primer is modified to include another explosive composition not including all TATB that is adapted for detonating the TATB in the main body, the shaped charge will, when detonated produce a jet that is longer in length than the jet associated with prior art shaped charges which did not have a main body of explosive that included TATB (and a non-all TATB primer). As a result, when the longer jet is produced from the shaped charge of the present invention, the longer jet will produce a longer perforation in a formation penetrated by a wellbore and, as a result, an increased quantity of wellbore fluid will be produced from the perforated formation.

Further scope of applicability of the present invention will become apparent from the detailed description presented hereinafter. It should be understood, however, that the detailed description and the specific examples, while representing a preferred embodiment of the present invention, are given by way of illustration only, since various changes and modifications within the spirit and scope of the invention will become obvious to one skilled in the art from a reading of the following detailed description.

BRIEF DESCRIPTION OF THE DRAWINGS

A full understanding of the present invention will be obtained from the detailed description of the preferred embodiment presented herein below, and the accompanying drawings, which are given by way of illustration only and are not intended to be limitative of the present invention, and wherein.

DETAILED DESCRIPTION OF THE PREFERRED EMBODIMENT

Figure 1:
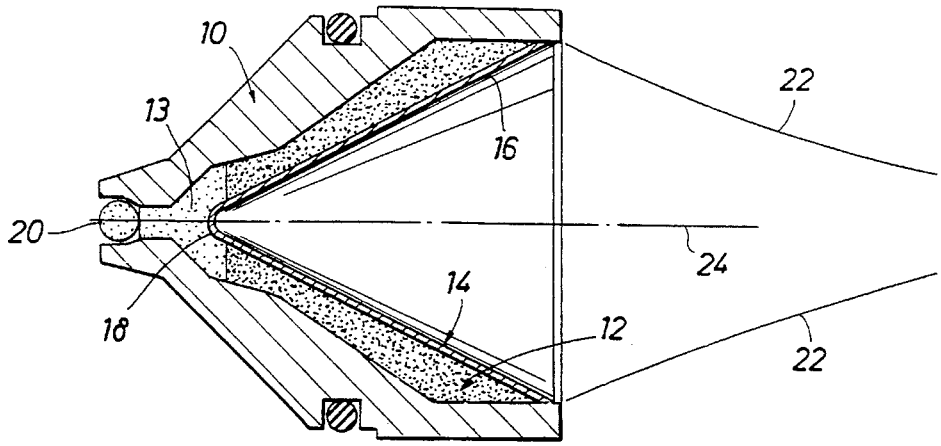
FIG. 1 illustrates a shaped charge that includes a main body of explosive that further includes 100% TATB or a mixture of TATB and either HNS, PYX or HMX and a primer that does not include 100% TATB, such as HNS, NONA, DODECA, PYX, HMX or a mixture of HNS, NONA, DODECA, PYX, HMX with TATB.

Referring to FIG. 1, a typical shaped charge adapted for use in a perforating gun is illustrated. The perforating gun is adapted to be disposed in a wellbore. A similar shaped charge is discussed in U.S. Pat. No. 4,724,767 to Aseltine, issued Feb. 16, 1988, and again in U.S. Pat. No. 5,413,048 to Werner et al issued May 9, 1995, the disclosures of which are incorporated by reference into this specification.

In FIG. 1, the shaped charge includes a case 10, a main body of explosive material 12 which in the past has been either RDX, HMX, PYX or HNS packed against the inner wall of case 10, a primer 13 disposed adjacent the main body of explosive 12 that is adapted to detonate the main body of explosive 12 when the primer 13 is detonated, and a liner 14 lining the primer 13 and the main body of explosive material 12. The shaped charge also includes an apex 18 and a skirt 16. A detonating cord 20 contacts the case 10 of the shaped charge at a point near the apex 18 of the liner 14 of the charge. When a detonation wave propagates within the detonating cord 20, the detonation wave will detonate the primer 13. When the primer 13 is detonated, the detonation of the primer 13 will further detonate the main body of explosive 12 of the charge. In response to the detonation of the main body of explosive 12, the liner 14 will form a jet 22 which will propagate along a longitudinal axis of the shaped charge. The jet 22 will perforate a formation penetrated by the wellbore.

As a result, the length of the jet 22 from the shaped charge of FIG. 1 is a function of the type of explosive which comprises the main body of explosive 12 in the shaped charge of FIG. 1. However, since the jet 22 is formed when the main body of explosive 12 is detonated, and since the main body of explosive 12 is detonated when the primer 13 is detonated, the type of explosive material which comprises both the primer 13 and the main body of explosive 12 must be carefully selected. Consequently, the length of the jet 22 from the shaped charge of FIG. 1 is a function of both: (1) the type of explosive material which comprises the main body of explosive 12, and (2) the type of explosive material which comprises the primer 13.

In the prior art, the main body of explosive 12 was comprised of an explosive material known either as "RDX", "HMX", "PYX" or "HNS". Therefore, the length of the jet 22 was a function of the type of explosive material, and its density, which constituted the main body of explosive 12, which was either RDX, HMX, PYX or HNS. However, in accordance with the present invention, it has been discovered that, when the main body of explosive 12 is comprised solely of an explosive material known as "Symtriaminotrinitrobenzene" (hereinafter called "TATB") or is comprised of a mixture of the TATB explosive material with another explosive material, such as HNS, PYX, or HMX, and when the primer 13 is carefully selected to be comprised of a sensitive explosive material that does not include 100% TATB, such as HNS or NONA or DODECA or PYX or HMX or a mixture of HNS or NONA or DODECA or PYX or HMX with TATB, the length of the jet 22 is increased. Therefore, in accordance with the present invention, the shaped charge of the present invention shown in FIG. 1 includes a main body of explosive 12 and a primer 13, where detonation of the primer 13 by the detonating cord 20 detonates the main body of explosive 12, detonation of the main body of explosive 12 producing the jet 22, the main body of explosive 12 including the explosive material known as TATB, the primer 13 including an explosive material that does not include 100% TATB explosive, such as HNS or NONA or DODECA or PYX or HMX or a mixture of HNS or NONA or DODECA or PYX or HMX with TATB.

The primer 13 must be comprised of a special explosive material, other than 100% TATB, because TATB, by itself, is not sensitive enough to be included as part of the primer 13. Therefore, the primer 13 must be comprised of a special explosive material other than 100% TATB in order for the primer 13 to be detonated, and that special explosive material could be HNS or NONA or DODECA or PYX or HMX or a mixture of HNS or NONA or DODECA or PYX or HMX with TATB. However, when that primer 13 is detonated, the main body of explosive 12 which includes TATB can then be detonated.

TATB is actually (1,3,5 trinitro-2,4,6 triamino benezene). A method of forming a fine grained species of the TATB is disclosed in U.S. Pat. No. 4,481,371 to Benziger, entitled "Method of Making Fine-Grained Triaminotrinitrobenzene", the disclosure of which is incorporated by reference into this specification. It is a high temperature stable explosive that is quite insensitive. In the past, the only use of TATB has been in atomic bombs. However, it has been discovered that the explosive TATB can be used as an ingredient in the main body of explosive 12 of shaped charges, like that shown in FIG. 1, if the TATB is sensitized by blending with another explosive known as HNS, if it is reduced in particle size, or if a larger primer of HNS, or other more sensitive primer explosive is used. When the shaped charge main body of explosive 12 includes TATB, and the primer 13 is carefully selected to be comprised of a sensitive explosive material other than TATB, such as HNS or NONA or PYX or HMX, the jet 22 produced from the shaped charge is increased in length relative to prior art shaped charges which did not include the TATB as part of the main body of explosive 12.

When TATB is included as an ingredient in the main body of explosive 12 of a shaped charge, the TATB need not be mixed with another explosive; however, when TATB is not mixed with another explosive, the TATB must consist of fine particle size granules, or a larger primer charge 13 of HNS, or other more sensitive primer explosive must be used.

However, when TATB is included as an ingredient in the main body of explosive 12 of a shaped charge, the TATB can be mixed with other explosive compositions, such as HNS, PYX, HMX, or other more sensitive explosives, and, when mixed with such other explosive compositions, the TATB used in the main body of explosive 12 need not consist of the fine particle size granules to increase its sensitivity.

Working Example

TATB was mixed with HNS in the following proportions (see Table 1 below) and the TATB/HNS mixture was used as the main body of explosive 12 of the new shaped charge of FIG. 1. Recall that, when TATB is included within the main body of explosive 12, the primer explosive 13 should not include 100% TATB. As a result, in this working example, the primer 13 included one of the following explosive materials: HNS or NONA, or DODECA or PYX or HMX or a primer mixture of: HNS or NONA, or DODECA or PYX or HMX with TATB. Tests were performed using the new shaped charge. The new shaped charges were detonated in simulated well conditions. When the new shaped charges were detonated during the test, successful tests were produced. The successful tests indicate that a longer jet 22 propagated from the shaped charge when the charge was detonated, and the longer jet 22 produced a longer perforation in a formation penetrated by a wellbore. In fact, the longer perforation represents a ten-percent (10%) improvement in the penetration, by the jet 22, of the formation relative to the penetration of the formation by the jets from prior an shaped charges which did not include TATB as an ingredient in the main body of explosive. See tables 1 and 2 below for the actual test results achieved when using the TATB (mixed with HNS and HMX) in the main body of explosive 12 of the shaped charge. The test results in table 1 represent the test results achieved when HNS is mixed with TATB, and the test results in table 3 represent the test results achieved when HMX is mixed with TATB. Consider table 1 below which represents the mixtures of TATB and HNS used as the main body of explosive 12 in shaped charges during the aforementioned successful tests which yielded the ten-percent (10%) better penetration by the jet 22 of the formation in the wellbore. However, of all the HNS/TATB mixtures, the 50%/50% mixture of HNS/TATB represents the preferred embodiment in terms of successful results. In fact, when the main body of explosive 12 of the shaped charge of FIG. 1 contained a mixture of HNS and TATB, where the HNS/rATB mixture includes a range from 0% to 75% of the HNS and a range from 25% to 100% of the TATB, the jet produced from the shaped charge following detonation will produce an approximate ten-percent (10%) better penetration of the formation in the wellbore relative to prior an shaped charges.

In addition, successful tests were also performed in the test well when the shaped charge primer 13 did not include TATB and the main body of explosive 12 included a mixture of TATB and HMX in the following proportions: 50%/50% mixture of TATB/HMX.

In addition, successful tests were also performed in simulated well conditions when the shaped charge primer 13 did not include TATB and the main body of explosive 12 included pure TATB (no mixture with another explosive). However, in this case, the TATB in the main body of explosive 12 consisted of small particle size (sonicated) pure TATB.

Consider tables 1 and 2 below which represents the actual test results achieved when TATB is mixed with either HNS and HMX in the main body of explosive 12 of the shaped charge of FIG. 1 and the primer 13 did not include any TATB.

The test results in table 1 below indicate the percent of HNS used in the main body of explosive 12, the percent of TATB (mixed with HNS) used in the main body of explosive 12, the diameter of the entrance hole in the formation in inches produced by the jet 22, and the penetration of the formation (the length of the perforation in the formation) in inches produced by the jet 22.

TABLE 1

Performance of TATB/HNS in 22 gram perforating shaped charge

| % HNS | % TATB | Entrance Hole (inches) | Penetration (inches) | Primer |
|---|---|---|---|---|
| 100 | 0 | 0.35 | 20.0 | 2 gm. HNS |
| 75 | 25 | 0.32 | 22.1 | 2 gm HNS |
| 50 | 50 | 0.32 | 22.6 | 2 gm HNS |
| 25 | 75 | 0.33 | 13.1 | 2 gm HNS |
| 0 | 100 | ragged | 0.37 | 2 gm HNS |
| 0 | 100 (12 micron) | 0.32 | 23.0 | 2 gm HNS |
| 0 | 100 | 0.31 | 22.2 | 4 gm HNS |
| 0 | 100 (12 micron) | misfire | misfire | 4 gm TATB (5 micron) |
| 50 | 50 | .33 | 22.1 | 2 gm (10% 5 micron TATB, 90% HNS) |
| 50 | 50 | .34 | 9.1 | 2 gm (50% 5 micron TATB, 50% HNS) |

In table 1 above, the HNS used to produce the results illustrated in table 1 contained 2% chlorofluorocarbon and 0.5% graphite. The mixes of TATB and HNS contained 38 micron TATB in the main body of the charge, and were initiated by a primer containing fine particle (8 micron) HNS. All shots in the above table 1 were made at 90° F. Note that the penetration fast increases then decreases as increasing amounts of TATB are added to the HNS main. The optimum blend appears to be in the range of 40–60% TATB. For higher percentage amounts of TATB, the performance decreases until the charge is on the verge of misfiring at 100 percent TATB in the main explosive. By further enhancing the sensitivity of the charge by increasing the amount of HNS primer from 2 grams to 4 grams, a main explosive composed of 100 percent TATB (38 micron) performed satisfactorily. We were not able to detonate successfully an all-TATB charge, even when we used smaller particle (12 micron) main and fine particle (5 micron) primer, a more sensitive primer, consisting of another, more sensitive explosive material, is needed. This does not, however, preclude small amount of TATB from being used as part of the primer. For example, a primer with 10 percent TATB and 90 percent HNS performed satisfactorily. Larger amounts of TATB, however, did not.

The data in table 1 above shows that, when the primer 13 and main body of explosive 12 in oil well perforating charges contain all TATB, the charge will not perform. If, however, the sensitivity of the primer 13 is increased by adding explosive materials more sensitive than TATB, the TATB can be used as the main body of explosive 12, alone, or mixed with other explosives. In addition, performance is improved. Results similar to those in Table 1 were also obtained with other sized charges.

The test results in table 2 below indicate the percent of HMX used in the main body of explosive 12, the percent of TATB (mixed with HMX) used in the main body of explosive 12, the diameter of the entrance hole in the formation in inches produced by the jet 22, and the penetration of the formation (the length of the perforation in the formation) in inches produced by the jet 22. The primer 13 was HMX, which is more sensitive than TATB.

TABLE 2

| Performance of TATB/HMX in 34 gram perforating shaped charges | | | |
|---|---|---|---|
| % HMX | % TATB | Entrance Hole (in) | Penetration (in) |
| 100 | 0 | 0.52 | 33.0 |
| 60 | 40 | 0.51 | 39.5 |
| 50 | 50 | 0.50 | 35.5 |

The table 2 results above show that mixtures of TATB and HMX (HMX is a more powerful explosive than HNS) also can be used and provides superior performance to that of HMX alone. However, this was not a universal result. The increase in penetration appears to be charge specific. Other size charges exhibited only equal or slightly greater penetration than HMX alone.

The test results in table 3 below indicate the percent of PYX used in the main body of explosive 12, the percent of TATB (mixed with PYX) used in the main body of explosive 12, the diameter of the entrance hole in the formation in inches produced by the jet 22, and the penetration of the formation (the length of the perforation in the formation) in inches produced by the jet 22. The primer 13 was PYX, which is known to be more sensitive than TATB.

TABLE 3

| Performance of TATB/PYX in 22 gram perforating shaped charges | | | |
|---|---|---|---|
| % PYX | % TATB | Entrance Hole (in) | Penetration (in) |
| 100 | 0 | 0.32 | 16.8 |
| 50 | 50 | 0.31 | 23.2 |

The table 3 results above show that mixtures of TATB and PYX also can be used and provides superior performance to that of PYX alone.

Referring to tables 4 and 5 below, a more comprehensive set of test results are illustrated. Tables 4 and 5 compare the test results achieved using the prior an shaped charge (where 100% HNS is used in main body of explosive 12) and the test results achieved using the shaped charge of the present invention (where TATB is used in different proportions with and without HNS in the main body of explosive 12). However, note that two different types of HNS are used in conjunction with Tables 4 and 5. Table 4 utilizes a 22 gram HNS charge, and Table 5 utilizes a 34 gram HNS charge.

In the tables 5 and 5, the first row of each table represents prior an data where the shaped charge being tested includes a main body of explosive 12 which consists of pure HNS.

However, in tables 4 and 5, the second and third rows of each table represent data in accordance with the present invention where the shaped charge being tested includes a main body of explosive 12 which further includes TATB (and a primer 13 not including TATB), the second row of each table representing a mixture of TATB with HNS in the main body of explosive 12 (and the primer 13 not including TATB), the third row of each table representing pure TATB in the main body of explosive 12 (and the primer 13 not including TATB).

In addition, in tables 4 and 5, a column is labeled "load force."The load force represents the force applied in pressing the TATB main body of explosive 12 against the case 10.

TABLE 4

| | load force (lb.) | diameter of entrance hole | length of penetration | comments |
|---|---|---|---|---|
| Prior Art - | | | | |
| 22 gram charge: HNS used in main body of explosive 12 | 38,000 | 0.34 inches | 20.27 inch | 4½ inch high shot density gun concrete target |
| invention - | | | | |
| 22 gram charge: 50% HNS and 50% TATB blend in main body of explosive 12 | 15,000<br>20,000<br>25,000<br>30,000<br>35,000 | 0.32 inch<br>0.32 inch<br>0.32 inch<br>0.32 inch<br>0.32 inch | 19.50 inch<br>21.50 inch<br>22.00 inch<br>24.00 inch<br>23.00 inch | 4½ inch high shot density gun concrete target |
| invention - | | | | |
| 22 gram charge: 100% pure TATB in main body explosive 12 | 12,000<br>12,000<br>12,000<br>12,000 | 0.29 inch<br>0.35 inch<br>0.32 inch<br>0.33 inch | 23.50 inch<br>21.50 inch<br>26.50 inch<br>20.50 inch | 3⅜ inch high shot density gun concrete target |

TABLE 5

| | load force (lb.) | diameter of entrance hole | length of penetration | comments |
|---|---|---|---|---|
| Prior Art - | | | | |
| 34 gram charge: HNS used in main body of explosive 12 | 45,000 | 0.42 inches | 25.80 inch | 3⅜ inch high shot density gun concrete target |
| invention - | | | | |
| 34 gram charge: 50% HNS and 50% TATB blend in main body explosive 12 | 15,000 | 0.41 inch | 28.75 inch | 3⅜ inch high shot density gun concrete target - one pass |
| invention - | | | | |
| 34 gram charge: 100% pure TATB in main body explosive 12 | 15,000 | 0.33 inch | 28.70 inch | 3⅜ inch high shot density gun concrete target |

Therefore, the results achieved by the shaped charge of the present invention, which uses TATB as an ingredient of the main body of explosive 12 and a primer 13 not including TATB, illustrate a ten percent (10%) improvement in penetration of the formation over the results achieved by the prior art shaped charge which do not utilize TATB as an ingredient in the main body of explosive 12. These results could not be achieved with a charge made of all TATB, since the charge would fail to detonate. A more sensitive primer explosive material is necessary to achieve detonation.

This advantage of the shaped charge of the present invention over the prior art shaped charge (the 10% improvement) is due to the higher density (compressibility), the higher detonation velocity, and the lower crushing strength of the TATB in the main body of explosive 12. Compressibility is an advantage because higher density of the TATB can be achieved with the same loading force. In general, higher density produces higher performance. However, the density of the main charge explosive is limited since, if it is compressed too much, the primer of the shaped charge would be over-compressed, and over-compressing the primer can result in a reduction of the sensitivity and the effectiveness of the primer. However, when TATB is used as an ingredient of the main body of explosive 12, higher density main shaped charges are produced, yet the loading forces as previously required remain the same. Since higher density main charges are produced with the same loading forces, higher performance results.

Figure 2:
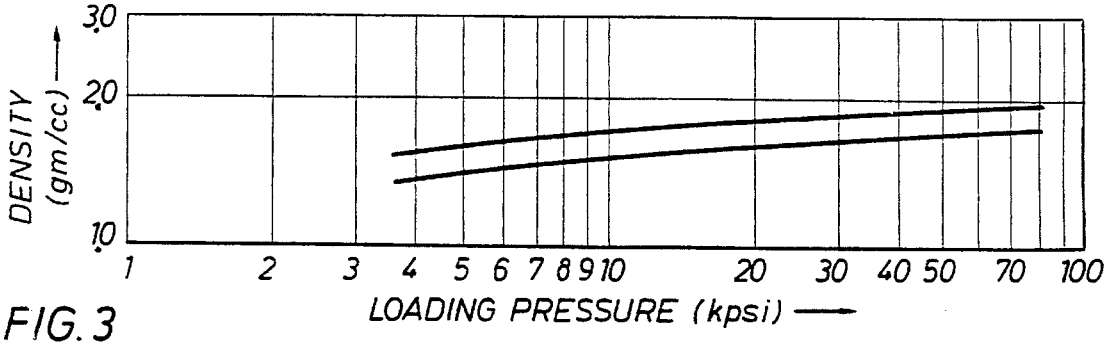
FIG. 2 illustrates a comparison of pressed density vs loading forces of HNS and TATB.

Referring to FIG. 2, a comparison of pressed density vs loading forces of HNS and TATB is illustrated.

Figure 3:
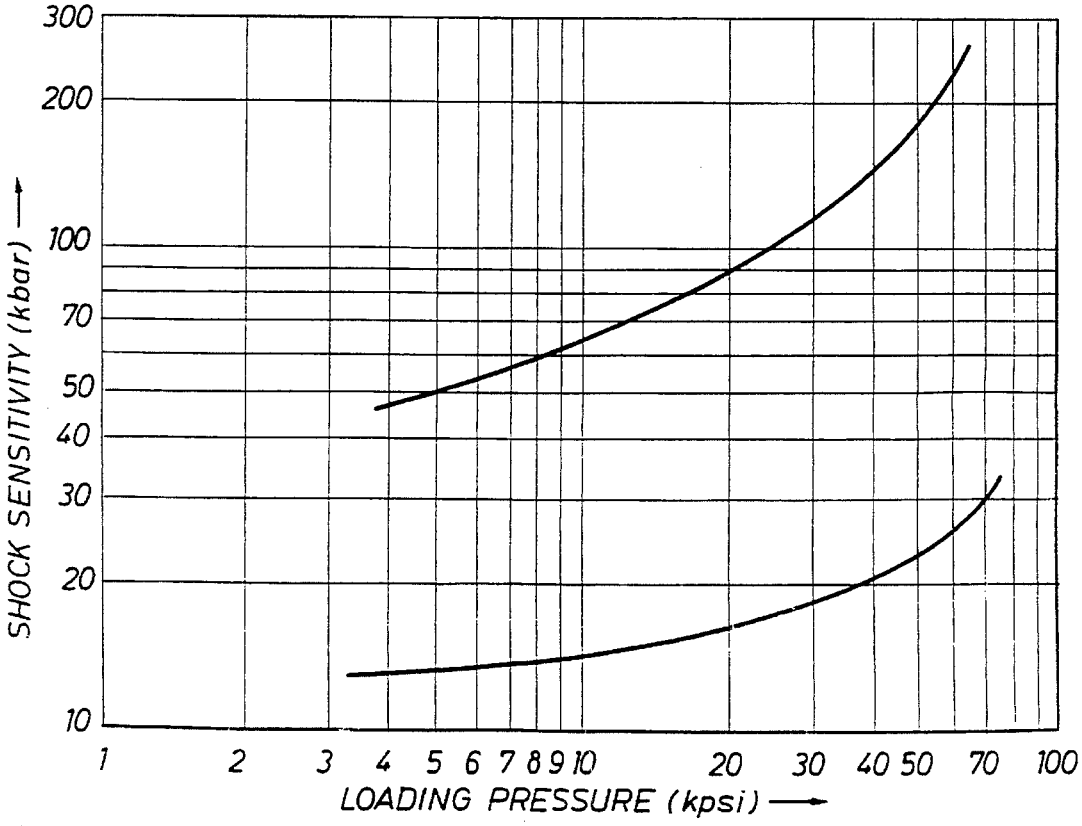
FIG. 3 illustrates the sensitivity of TATB compared with HNS, in the NOL small scale gap test.

Referring to FIG. 3, the sensitivity of TATB compared with HNS, in the NOL small scale gap test, is illustrated.

The specification of this application set forth above has disclosed a shaped charge including a main body of explosive which further includes TATB or a mixture of TATB and another explosive.

However, it should be apparent that other apparatus could include the TATB explosive. For example, a detonating cord includes an explosive, and that explosive in the detonating cord could include the TATB explosive, or a mixture of the TATB explosive and the HNS explosive, or a mixture of the TATB explosive and one of the other explosives mentioned in this specification, having similar benefits and results.

The invention being thus described, it will be obvious that the same may be varied in many ways. Such variations are not to be regarded as a departure from the spirit and scope of the invention, and all such modifications as would be obvious to one skilled in the an are intended to be included within the scope of the following claims.

We claim:

1. A shaped charge, comprising:

a case;

a main body of explosive disposed in said case, said main body of explosive including sym-triaminotrinitrobenzene (TATB); and a primer disposed in said case adapted for detonating said main body of explosive, said primer being more sensitive than said TATB.

2. The shaped charge of claim 1, wherein said primer is selected from the group consisting of: HNS, NONA, DODECA, PYX, HMX.

3. The shaped charge of claim 1, wherein said primer comprises a mixture of said TATB with another explosive, said another explosive being either HNS, NONA, DODECA, PYX, or HMX.

4. The shaped charge of claim 1, wherein said main body of explosive includes approximately 100% of said TATB.

5. The shaped charge of claim 1, wherein said main body of explosive includes said TATB and another explosive, said another explosive being HNS.

6. The shaped charge of claim 5, wherein said main body of explosive includes approximately 25% of said TATB and approximately 75% of said HNS.

7. The shaped charge of claim 5, wherein said main body of explosive includes approximately 40% of said TATB and approximately 60% of said HNS.

8. The shaped charge of claim 5, wherein said main body of explosive includes approximately 50% of said TATB and approximately 50% of said HNS.

9. The shaped charge of claim 1, wherein said main body of explosive includes said TATB and another explosive, said another explosive being HMX.

10. The shaped charge of claim 1, wherein said main body of explosive includes said TATB and another explosive, said another explosive being PYX.

11. A method of manufacturing a shaped charge, comprising the steps of:

(a) inserting a main body of explosive into a case, said main body of explosive including sym-triaminotrinitrobenzene (TATB);

(b) inserting a primer into said case adapted for detonating said main body of explosive, said primer including an explosive which is more sensitive than said TATB; and (c) inserting a liner over said main body of explosive.

12. The method of claim 11, wherein said primer is selected from the group consisting of: HNS, NONA, DODECA, PYX, and HMX.

13. The method of claim 11, wherein said primer comprises a mixture of said TATB and another more sensitive explosive, said another explosive being either HNS, NONA, DODECA, PYX, or HMX.

14. The method of claim 11, wherein the inserting step (a) comprises the steps of:

compressing said main body of explosive, including said TATB and another explosive, into said case.

15. The method of claim 14, wherein said another explosive includes HNS, the compressing step including the step of:

compressing the main body of explosive, including said TATB and said HNS, into said case.

16. The method of claim 14, wherein said another explosive includes HMX, the compressing step including the step of:

compressing the main body of explosive, including said TATB and said HMX, into said case.

17. A shaped charge, comprising:

a case; and a main body of explosive in said case, said main body of explosive including sym-triaminotrinitrobenzene (TATB).

18. The shaped charge of claim 17, further comprising:

a primer adapted for detonating said main body of explosive, said primer including another explosive which does not include said TATB and which is more sensitive than said TATB.

19. The shaped charge of claim 18, wherein said primer is selected from a group consisting of: HNS, NONA, DODECA, PYX, and HMX.

20. The shaped charge of claim 18, wherein said main body of explosive comprises a mixture of said TATB and a further explosive, said further explosive being either HNS, NONA, DODECA, PYX, or HMX.

21. The shaped charge of claim 17, wherein said main body of explosive comprises a mixture of said TATB and HNS.

22. The shaped charge of claim 21, wherein said mixture of said TATB and HNS includes a range of zero percent (0%) to seventy-five percent (75%) of said HNS and a range of twenty-five percent (25%) to one-hundred percent (100%)of said TATB.

23. A detonating cord, comprising:

an explosive, said explosive including sym-triaminotrinitrobenzene (TATB).

* * * * *